US008390519B2

(12) United States Patent
Wang et al.

(10) Patent No.: US 8,390,519 B2
(45) Date of Patent: Mar. 5, 2013

(54) DUAL-FEED DUAL BAND ANTENNA ASSEMBLY AND ASSOCIATED METHOD

(75) Inventors: Dong Wang, Waterloo (CA); Qinjiang Rao, Waterloo, CA (US)

(73) Assignee: Research In Motion Limited, Waterloo (CA)

( * ) Notice: Subject to any disclaimer, the term of this patent is extended or adjusted under 35 U.S.C. 154(b) by 494 days.

(21) Appl. No.: 12/683,965

(22) Filed: Jan. 7, 2010

(65) Prior Publication Data

US 2011/0163922 A1 Jul. 7, 2011

(51) Int. Cl.
*H01Q 1/38* (2006.01)
*H01Q 1/24* (2006.01)
*H01Q 5/01* (2006.01)

(52) U.S. Cl. ..... 343/700 MS; 343/702; 343/729

(58) Field of Classification Search ..... 343/700 MS, 343/702, 826, 828, 829, 846, 858, 725, 729
See application file for complete search history.

(56) References Cited

U.S. PATENT DOCUMENTS

| | | | | |
|---|---|---|---|---|
| 6,381,471 | B1 | 4/2002 | Dvorkin | |
| 6,426,723 | B1 * | 7/2002 | Smith et al. | 343/700 MS |
| 6,448,932 | B1 | 9/2002 | Stoiljkovic et al. | |
| 6,894,647 | B2 * | 5/2005 | Jenwatanavet | 343/700 MS |
| 2009/0213011 | A1 | 8/2009 | Tsai et al. | |
| 2009/0251381 | A1 | 10/2009 | Chou et al. | |

FOREIGN PATENT DOCUMENTS

| | | |
|---|---|---|
| CA | 2727102 | 7/2011 |
| EP | 2346133 | 7/2011 |

OTHER PUBLICATIONS

T. Yestrebsky, "MICRF001 Antenna Design Tutorial", App. Note 23, Micrel, Jul. 1999, 8pgs.
Q. Rao and D. Wang, "Compact Low Coupling Dual-Antennas for MIMO Applications in Handheld Devices", IEEE, 2009, 4 pgs.
D. Wang and Q. Rao, "Patch Loaded Tri-Monopole Wideband Antenna for Mobile Applications", 3 pgs.
Geyi et al., "Handset Antenna Design: Practice and Theory", Progress in Electromagnetics Research, PIER 80, pp. 123-160, 2008.
KIPO, Office Action, Application No. 10-2011-0001441, Dec. 21, 2011, 3 pgs.
KIPO, Notice of Decision for Patent, Application No. 10-2011-0001441, Jul. 10, 2012, 3 pgs.

* cited by examiner

*Primary Examiner* — Michael C Wimer
(74) *Attorney, Agent, or Firm* — The Danamraj Law Group, P.C.

(57) ABSTRACT

A dual-feed port dual band (DFDB) antenna module comprising a first antenna element disposed on a first planar surface, a second antenna element disposed on a second planar surface, and a third antenna element disposed on a third planar surface. A first feed port is coupled to a first transceiver circuit adapted to operate in a first band and a second feed port is coupled to a second transceiver circuit adapted to operate in the first band and to a receiver circuit adapted to operate in a second band. The first and second feed ports are oriented substantially orthogonal with respect to each other.

13 Claims, 9 Drawing Sheets

Measured antenna 3D radiation pattern at 2.45 GHz

DUAL-FEED DUAL BAND ANTENNA ASSEMBLY AND ASSOCIATED METHOD

FIELD OF THE DISCLOSURE

The present patent disclosure generally relates to antennas. More particularly, and not by way of any limitation, the present patent disclosure is directed to a dual-feed dual band (DFDB) antenna assembly and associated method.

BACKGROUND

Recently, there has been an increasing thrust in the application of internal antennas in wireless communications devices. The concept of an internal antenna stems from the avoidance of using an external radiating element through the integration of the antenna into the communications device itself. Internal antennas have several advantageous features such as being less prone to external damage, a reduction in overall size of the communications device with optimization, and easy portability. In most internal antennas, the printed circuit board of the communications device serves as the ground plane of the internal antenna.

With the advent of mobile communications devices capable of operating in more than one band, designers have begun to use separate antennas in conjunction with a switching unit wherein each antenna operates in a distinct frequency band. The switching unit selectively connects a transceiver of the communications device to one of the antennas. The conventional dual-band antennas, however consume a large amount of power and are known to have high manufacturing costs.

The foregoing concerns become even more pronounced where a communications device is required to operate in multiple radio applications such as, e.g., WiFi, Bluetooth and GPS applications. In particular, a significant challenge arises in terms of high coupling when a dual-feed antenna is implemented for operating at the same frequency band in a compact device such as a mobile communications device where stringent form factor and footprint requirements are typically the norm. Relatedly, high coupling between the feed ports can give rise to decreased radiation efficiency of the antenna as well.

In addition, current antenna solutions for Multiple Input Multiple Output (MIMO) applications require multiple antennas, which can result in duplication of certain parts of to build the communications device, thereby necessitating usually unfavorable trade-offs between device size and performance. Such trade-offs can be that smaller devices may suffer performance problems, including shortened battery life and potentially more dropped calls, whereas devices with better performance require larger housings. In general, the driver of this trade-off is mutual coupling between the antennas, which can result in wasted power when transmitting and a lower received power from incoming signals. In MIMO technologies such as Long Term Evolution (LTE), where two receive antennas are required, such cross-coupling effects can be highly undesirable since effective MIMO performance requires relatively low correlation between each of the received signals of the multiple antennas. Currently, this is typically accomplished in large devices using one or more of: spatial diversity (distance between antennas), pattern diversity (difference between antenna aiming directions), and polarization diversity. Unfortunately, when multiple antennas are used within a mobile handheld device, the signals received by each of the antennas are undesirably correlated, due to the tight confines typical of the compact devices that are favored by consumers. This noticeably disrupts MIMO performance. The trade-off is then to either enlarge the device, which may not be well received by the consumers, or else tolerate reduced performance.

BRIEF DESCRIPTION OF THE DRAWINGS

A more complete understanding of the embodiments of the present patent disclosure may be had by reference to the following Detailed Description when taken in conjunction with the accompanying drawings wherein.

DETAILED DESCRIPTION OF THE DRAWINGS

Figure 1:
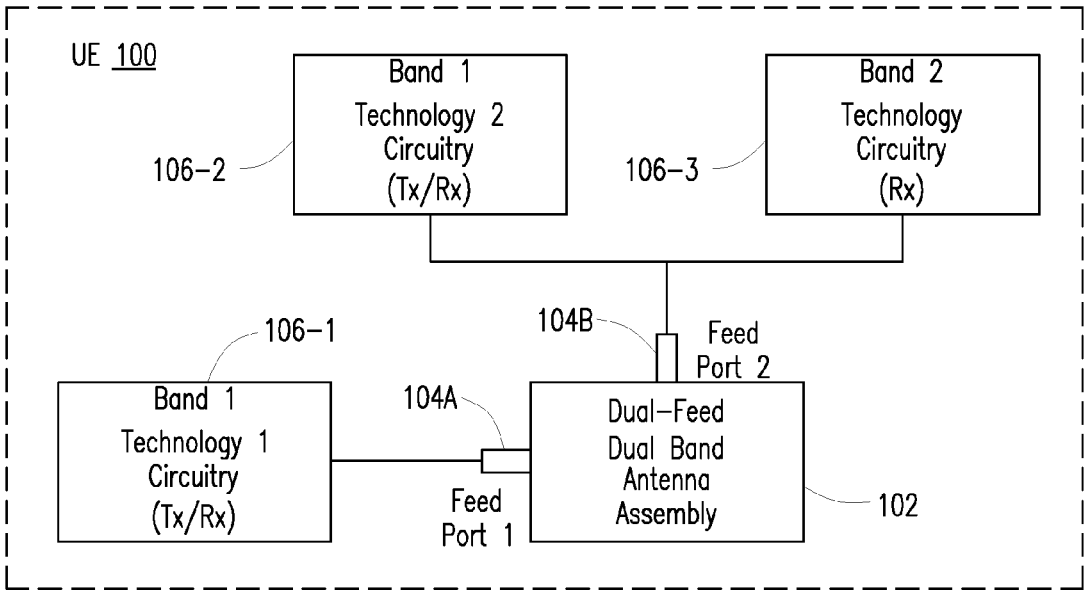
FIG. 1 depicts a functional block diagram of an example wireless user equipment (UE) device having an embodiment of a dual-feed dual band (DFDB) antenna assembly of the present patent application.

The present patent disclosure is broadly directed to a dual-feed dual band (DFDM) antenna for multiple applications wherein high cross-port isolation is achieved (i.e., coupling is reduced) while still maintaining a stringent form factor. Additionally, the need for a switching unit is also obviated.

In one aspect, an embodiment of a DFDB antenna module is disclosed which comprises: a first feed port coupled to a first transceiver circuit adapted to operate in a first band; and a second feed port coupled to a second transceiver circuit adapted to operate in the first band and to a receiver circuit adapted to operate in a second band, wherein first and second feed ports are placed in respective planar surfaces that are substantially orthogonal with respect to each other.

In another embodiment, a DFDB antenna module of the present disclosures comprises: a first antenna element disposed on a first planar surface; a second antenna element disposed on a second planar surface; and a third antenna element disposed on a third planar surface, wherein the first, second and third planar surfaces are substantially orthogonal with respect to one another and wherein the first and second antenna elements are in electrical contact at a first common edge therebetween and the first and third antenna elements are in electrical contact at a second common edge therebetween and the second and third antenna elements are in electrical contact at a third common edge therebetween, and further wherein the first antenna element includes a feed port for coupling to one type of transceiver circuitry adapted to operate in a short-range wireless communications band and the second antenna element includes another feed port for coupling to another type of transceiver circuitry also adapted to operate in the short-range wireless communications band such that the feed ports are substantially orthogonal to each other and either of the feed ports is further configured to couple to receiver circuitry adapted to operate in a GPS band.

In another aspect, an embodiment of a method for assembling a DFDB antenna module is disclosed. The claimed embodiment comprises one of more of the following features: providing a first radiating element operable with a first transceiver circuit adapted to operate in a first band; providing a second radiating element operable with a second transceiver circuit adapted to operate in a second band; and providing a third radiating element operable with a receiver circuit adapted to operate in the second band, wherein the first, second and third radiating elements are disposed on respective first, second and third planes that are substantially orthogonal to one another and wherein the second and third radiating elements each include a feed port substantially orthogonal to each other.

In a still further aspect, an embodiment of a wireless UE device is disclosed. The claimed embodiment comprises one of more of the following features: a first transceiver circuit adapted to operate in a first band; a second transceiver circuit adapted to operate in the first band; a receiver circuit adapted to operate in a second band; and a DFDB antenna module having a first feed port and a second feed port, wherein the first and second feed ports are respectively coupled to the first and second transceiver circuits, and further wherein the receiver circuit is configured to be coupled to one of the first and second feed ports.

Embodiments of apparatus and associated method relating to a DFDB module or assembly thereof of the present patent disclosure will now be described with reference to various examples of how the embodiments can best be made and used. Like reference numerals are used throughout the description and several views of the drawings to indicate like or corresponding parts to the extent feasible, wherein the various elements may not necessarily be drawn to scale. Referring now to the drawings, and more particularly to FIG. 1, depicted therein is a functional block diagram of an example wireless UE device 100 having an embodiment of a DFDB antenna assembly 102 of the present patent application. Without any limitation, UE 100 may comprise any mobile communications device that is capable of wireless communications in multiple bands and/or access technologies, effectuating, for example, both short-range communications as well as wide area cellular telephony communications, either in packet-switched network domains, circuit-switched network domains, or both. Accordingly, by way of illustration, UE 100 having an antenna assembly embodiment of the present patent disclosure may be operable with any frequency range or ranges associated with MIMO antennas of a Long-Term Evolution (LTE) network. In addition, UE 100 can also effectuate wireless communications in frequency range or ranges according to such standards as, e.g., the well-known Institute of Electrical and Electronics Engineers (IEEE) standards, like IEEE 802.11a/b/g/n standards or other related standards such as HiperLan standard, HiperLan II standard, Wi-Max standard, OpenAir standard, and Bluetooth standard.

Regardless of the foregoing technologies and/or bands set forth above, an antenna assembly embodiment of the present disclosure will be particularly exemplified hereinbelow with respect to a long-range wireless communications technology such as MIMO antenna for LTE and two short-range wireless communications technologies such as the Bluetooth and WiFi technologies as well as a satellite-based communications technology such as GPS that is operable in applicable band(s). Thus, one skilled in that art will recognize that LTE bands ranging from 2.0 GHz to 2.8 GHz may be utilized in conjunction with the antenna operation of UE 100. Likewise, the Bluetooth and WiFi bands may include frequency ranges such as 2.4 GHz. As illustrated in the functional block diagram of FIG. 1, the DFDB antenna assembly 102 includes a first feed port or point 104A coupled to a first transceiver circuit 106-1 operating in a first band. A second feed port or point 104B is coupled to a second transceiver circuit also adapted to operate in the same first band. In accordance with the teachings of the present disclosure set forth in further detail below, a receiver circuit 106-3 operable in a second band can also be coupled to either the first feed port 104A or the second feed port 104B at least as long as the two feed ports are placed in respective planar surfaces that are substantially orthogonal with respect to each other. By way of illustration, first transceiver circuit 106-1 may comprise Bluetooth-compatible circuitry adapted to operate in the 2.4 GHz band, second transceiver circuit 106-2 may comprise WiFi-compatible circuitry also adapted to operate in the 2.4 GHz band, and receiver circuit 106-3 may comprise GPS circuitry coupled to the second feed port 104B. In a further variation, the first and second transceiver circuits can be interchanged between the two feed ports, i.e., transceiver circuitry 106-2 may be coupled to feed port 104A while transceiver circuitry 106-1 may be coupled to feed port 104B. In addition, as alluded to before, the second band circuitry, i.e., GPS circuitry 106-3, can be coupled to either feed port 104A or feed port 104B regardless of the feeding connections of the two short-range transceiver circuits. Accordingly, one skilled in the art will recognize that the use of "first", "second" or "third", etc. in the present disclosure in referencing the various transceiver or receiver circuits in different bands, or associated structural components or antenna elements, can be somewhat variable and may not necessarily be fixed to a specific element, depending on the particular aspects or embodiments being exemplified.

Figure 2:
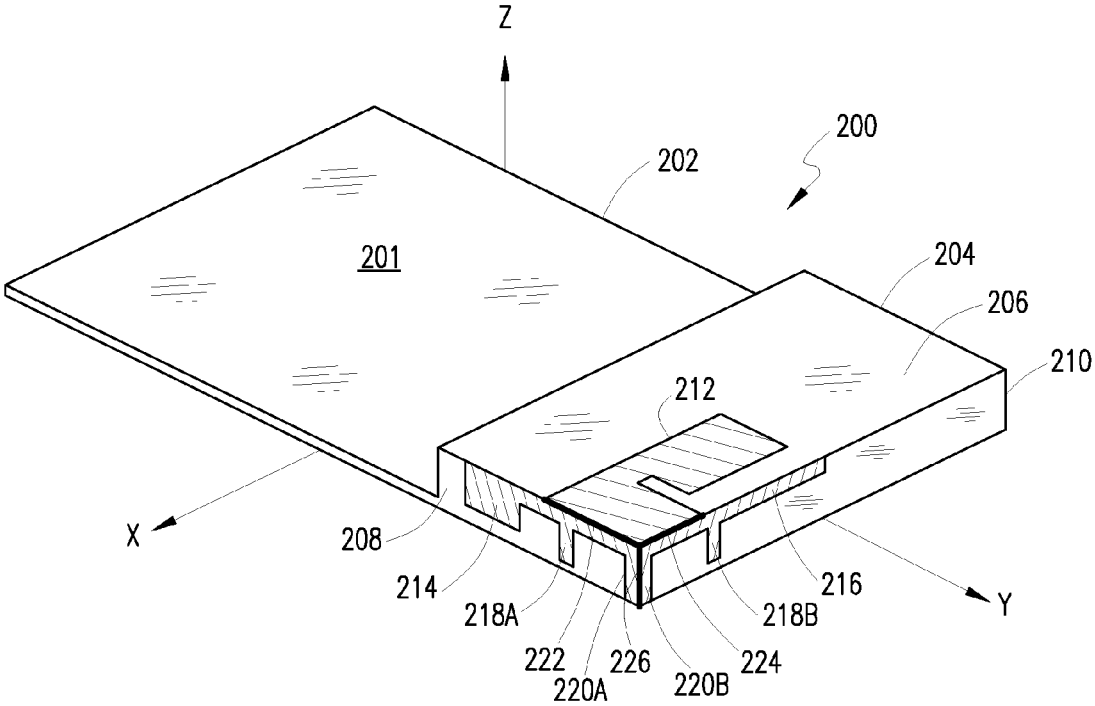
FIG. 2 depicts an example embodiment of a DFDB antenna module or assembly in an isometric view representation.

FIG. 2 depicts an example embodiment of a DFDB antenna module or assembly 200 in an isometric view representation, which can be employed in UE 100 described above for purposes of the present patent disclosure. A suitable substrate 201 with appropriate requisite properties is provided for supporting conductive antenna portions or elements as well as grounding. As illustrated, substrate 201 is comprised of portions 202 and 204, wherein portion 204 can be thicker than portion 202, whose sizes or measurements will be set forth in additional detail below in respect of an exemplary embodiment. Three antenna elements are provided in association with the thicker portion 204 of substrate 201 such that (i) each antenna element is adapted to operate in conjunction with a suitable transceiver or receiver circuit; and (ii) each antenna element is disposed on a planar surface of the thicker portion 204 relative to one another in a substantially orthogonal arrangement. In the illustrated embodiment of FIG. 2, reference numerals 206, 208 and 210 refer to the three planar surfaces, i.e., XOY, YOZ and XOZ surfaces, wherein the YOZ and XOZ surfaces may be viewed as vertical planes (that show side views) and the XOY surface may be viewed as a horizontal plane that shows a top plane view of the exemplary DFDW module 200. An antenna or radiating element 212 is disposed on the XOY planar surface 206, an antenna or radiating element 214 is disposed on the YOZ planar surface 208, and another antenna or radiating element 216 is disposed on the XOZ planar surface 210. In one illustrative nomenclature, antenna element 216 may be referred to as first element, antenna element 214 may be referred to as second element, and antenna element 212 may be referred to as third element. Further, the XOZ planar surface 210, the YOZ planar surface 208, and the XOY planar surface 206 may be illustratively referred to as first, second and third surfaces, respectively, subject to the variable nomenclature of the present patent application.

In the illustrative arrangement of FIG. 2, it is clear that the first, second and third planar surfaces are at least substantially orthogonal with respect to one another. Further, the third and second antenna elements 212, 214 are in electrical contact at a common connection edge 222 therebetween. Likewise, the third and first antenna elements 212, 216 and the second and first antenna elements 214, 216 are in electrical contact at respective common connection edges 224 and 226, respectively. By way of illustration, third antenna element 212 is provided as a patch antenna element, second antenna element 214 is provided as a modified inverted F antenna (MIFA) strip element and first antenna element 216 is provided as an inverted F antenna (IFA) strip element, wherein the exemplary physical dimensions of the respective antenna elements are set forth in detail below.

Antenna elements 214 and 216 each comprise a feed port portion and a contact portion, whereby two feed ports are respectively formed for coupling with two different transceiver circuits, e.g., the Bluetooth and WiFi transceiver circuits, operating in the same short-range wireless communications band as described above. As exemplified in FIG. 2, a feed port portion 218A is provided as part of the MIFA element 214 and a feed port portion 218B is provided as part of the IFA element 216. Respective contact portions 220A and 220B coupled at connection edge 226 are operable as a ground point or pin. Patch antenna element 212 is adapted to operate in GPS frequency range. Because of the spatial orientation of the illustrative antenna elements, the feed ports are also at least substantially orthogonal to each other, and in one exemplary embodiment, are separated by a distance of only around 15 mm while still achieving sufficient radiation isolation between the two ports.

Figure 3A:
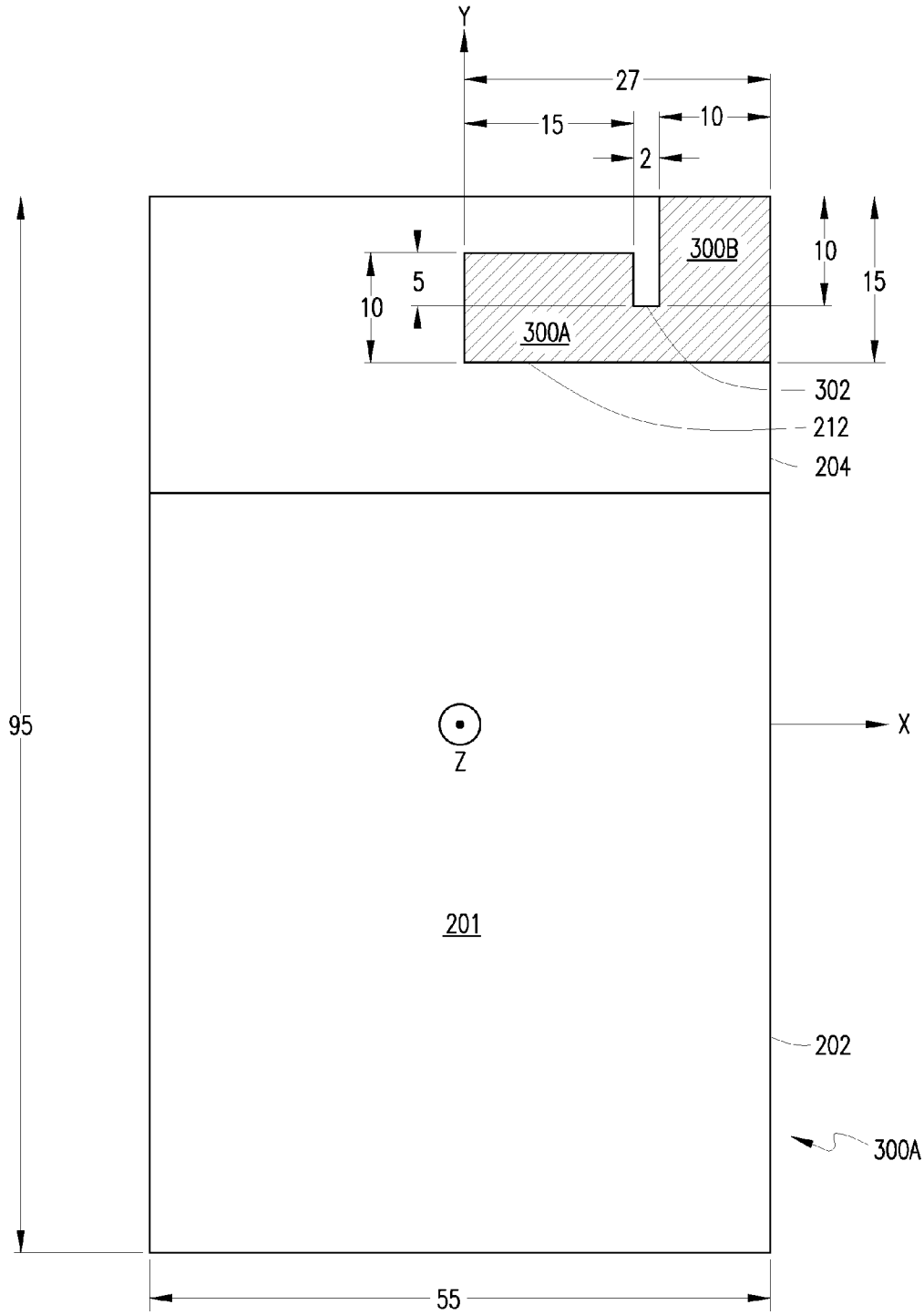
FIG. 3A is an XOY plane view of the DFDB antenna module assembly of FIG. 2.

Set forth below are planar and side views of the exemplary DFDB antenna module 200 of FIG. 2 wherein various example and/or approximate dimensions are shown in millimeters. FIG. 3A is an XOY plane view 300A of the DFDB antenna module assembly 200 wherein, as illustrated, substrate 201 has a length of about 95 mm and a width of about 55 mm. Patch antenna element 212 disposed on the horizontal plane of portion 204 is comprised of a first rectangular portion 300A and a second rectangular portion 300B that are coupled via a neck or notch portion 302. Each rectangular portion is about 15 mm by 10 mm and may be arranged at a substantially right angle, i.e., in an "L" shape, with the neck/notch being about 5 mm by 2 mm.

Figure 3C:
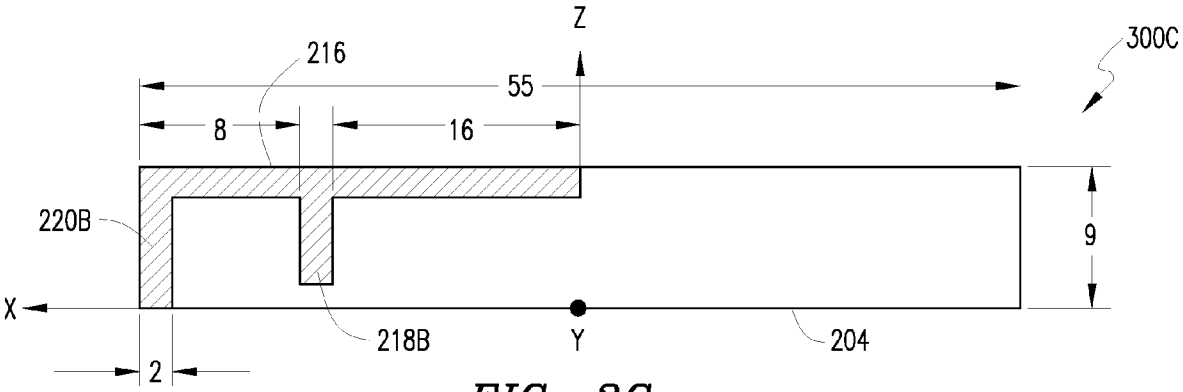
FIG. 3C is an XOZ side view of the DFDB antenna module assembly of FIG. 2.
Figure 3B:
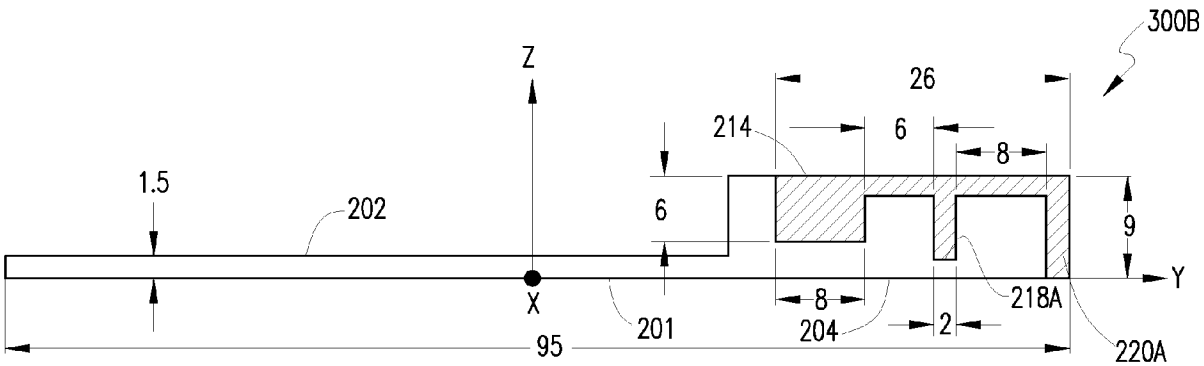
FIG. 3B is a YOZ side view of the DFDB antenna module assembly of FIG. 2.

FIG. 3B is a YOZ side view 300B of the DFDB antenna module assembly 200. Portion 202 of substrate 201 is about 1.5 mm thick and portion of 204 of substrate 201 is about 9 mm thick. MIFA element 214 is about 26 mm long, with feed port portion 218A being about 2 mm thick. FIG. 3C is an XOZ side view 300C of the DFDB antenna module assembly 200 wherein a width of about 55 mm and a thickness of about 9 mm of portion 204 are illustrated. IFA element 216 is about 26 mm long, with feed port portion 218B being about 6-8 mm from the contact portion 220B.

Figure 4:
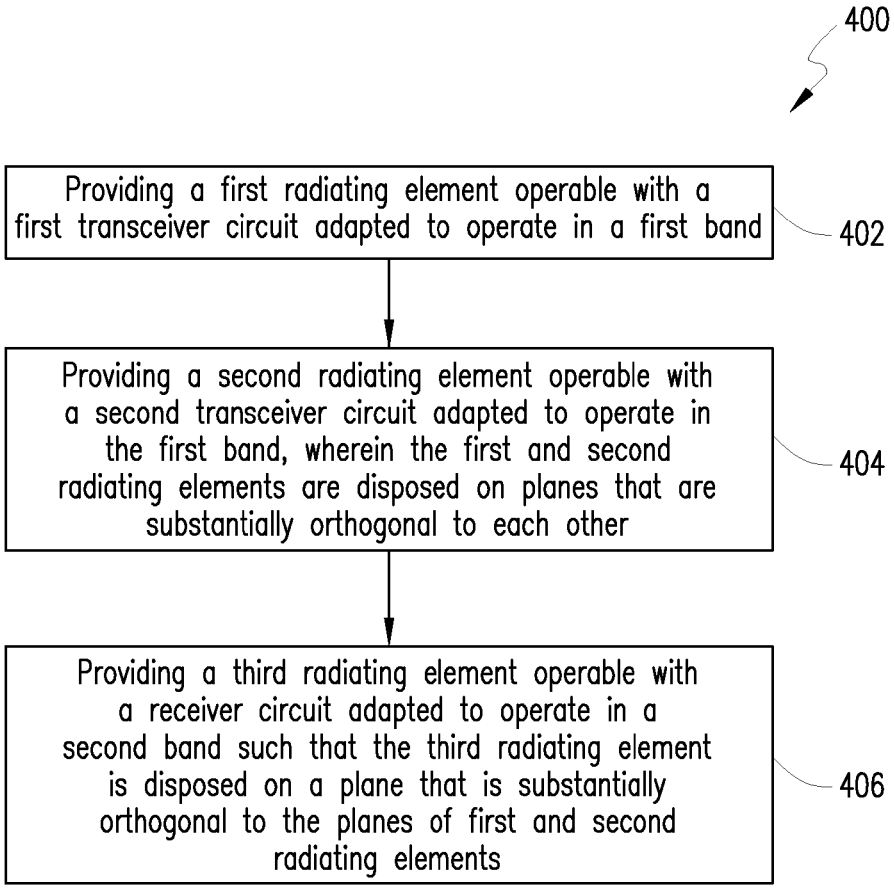
FIG. 4 is a flowchart of an example method of the present patent application.

FIG. 4 is a flowchart of an example method 400 of the present patent application with respect to assembling a DFDB module in one embodiment. A first radiating element operable with a first transceiver circuit adapted to operate in a first band is provided on a suitable substrate with appropriate shape, geometry, measurements, and the like (block 402). A second radiating element operable with a second transceiver circuit adapted to operate in a second band is provided on the substrate (block 404). A third radiating element operable with a receiver circuit adapted to operate in the same second band is also provided on the substrate (block 406), wherein the first, second and third radiating elements are disposed on respective first, second and third planes of the substrate that are substantially orthogonal to one another. As described set forth above in additional detail, the second and third elements each include a feed port that are substantially orthogonal to each other.

Figure 5A:
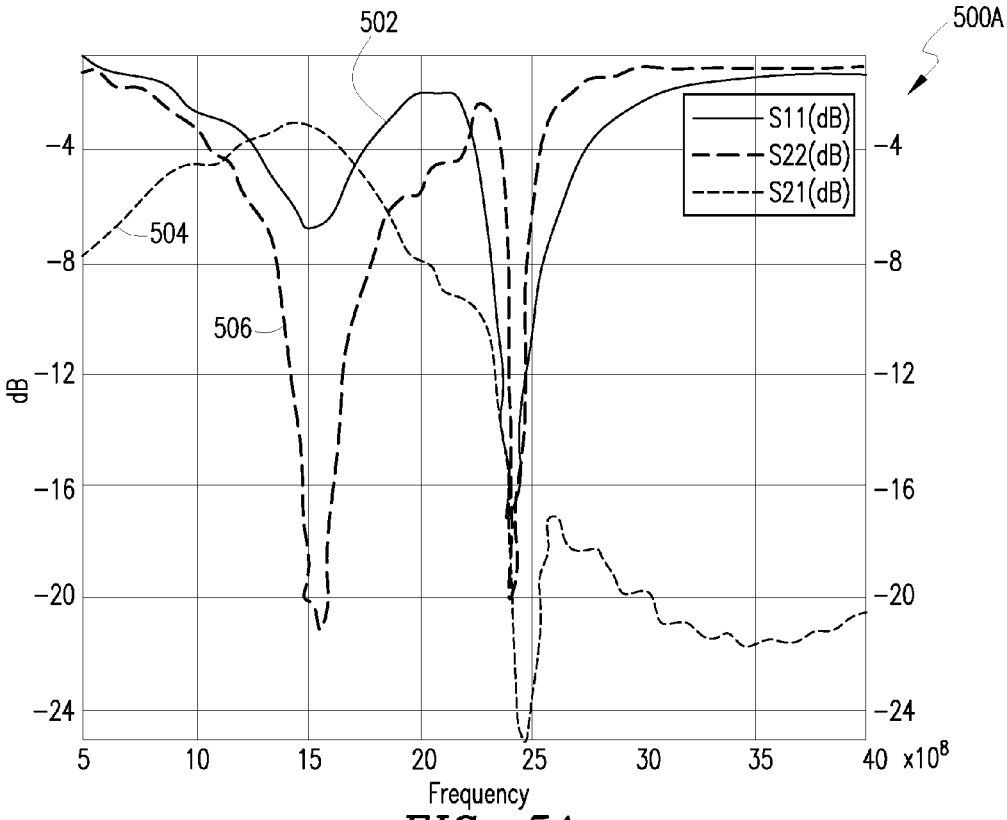
FIG. 5A depicts example graphs of simulated scattering (S) parameters associated with an embodiment of the DFDB antenna module of the present patent application.
Figure 5B:
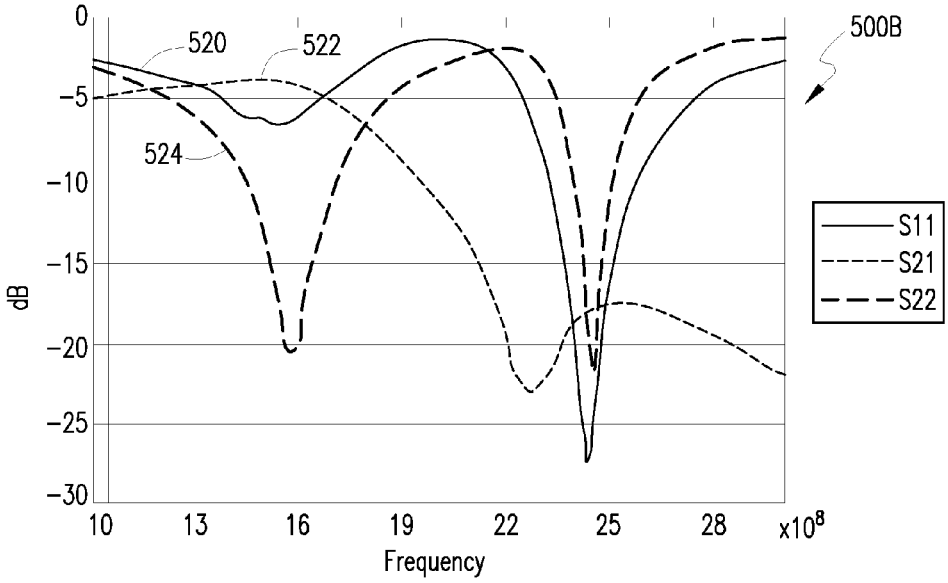
FIG. 5B depicts example graphs of measured S parameters associated with an embodiment of the DFDB antenna module of the present patent application.

FIGS. 5A and 5B respectively depict example graphs 500A, 500B of simulated and measured scattering (S) parameters associated with an embodiment of the DFDB antenna module of the present patent application. As one of skill in the art can appreciate, S-parameters refer to the elements of what is known as the scattering matrix, a mathematical construct that quantifies how electromagnetic (EM) radiation (e.g., RF energy) propagates through a network having one or more ports. For an RF signal incident on one port, some fraction of the signal bounces back out from that port, some of it scatters and exits from other ports (i.e., inter-port coupling), and some of it may disappear as heat or even EM radiation. The S-matrix for an N-port network thus contains $N^2$ coefficients (in an N-by-N matrix).

In a basic sense, S-parameters refer to RF "voltage out versus voltage in" relationships of the ports. Accordingly, parameter $S_{ij}$ refers to the in/out relationship where "j" is the port that is excited (i.e., the input port where the EM radiation is incident) and "i" is the output port. While S-parameters are complex variables (having both magnitude and phase angle), often only the magnitudes are measured since it is generally more relevant to determine how much cross-port gain (or loss) is effected in a design. While S-parameters are commonly defined for a given frequency and system impedance, they vary as a function of frequency for any non-ideal network.

In a two-port scenario applicable to the exemplary DFDB antenna assembly module of the present disclosure, there are two feed ports, thereby giving rise to a 2×2 matrix having four S-parameters. For the two-port DFDB antenna assembly, accordingly, the S-matrix comprises the following four elements: $\{S_{11}, S_{12}, S_{21}, S_{22}\}$, where the diagonal elements (i.e., $S_{11}$ and $S_{22}$) are referred to as reflection coefficients because they describe what happens at a single port (either port 1 or port 2). The off-diagonal elements (i.e., $S_{12}$ and $S_{21}$) are referred to as transmission coefficients since they describe the cross-port phenomena. As illustrated in FIG. 5A, reference numerals 502, 504 and 506 refer to simulated $S_{11}$, $S_{21}$ and $S_{22}$ functions plotted in dB versus frequency based on a model derived for the exemplary DFDB antenna module. It can be seen that each simulated S-parameter shows desirable characteristics at around 2.4 GHz to 2.5 GHz. In particular, cross-port isolation of over −20 dB can be seen based on the $S_{21}$ parametric simulation. Corresponding results are also seen from FIG. 5B where the $S_{11}$, $S_{21}$ and $S_{22}$ parameters are measured and plotted in dB versus frequency (reference numerals 520, 522 and 524) in an example test setup utilizing an embodiment of the DFDB antenna module.

Figure 6A:
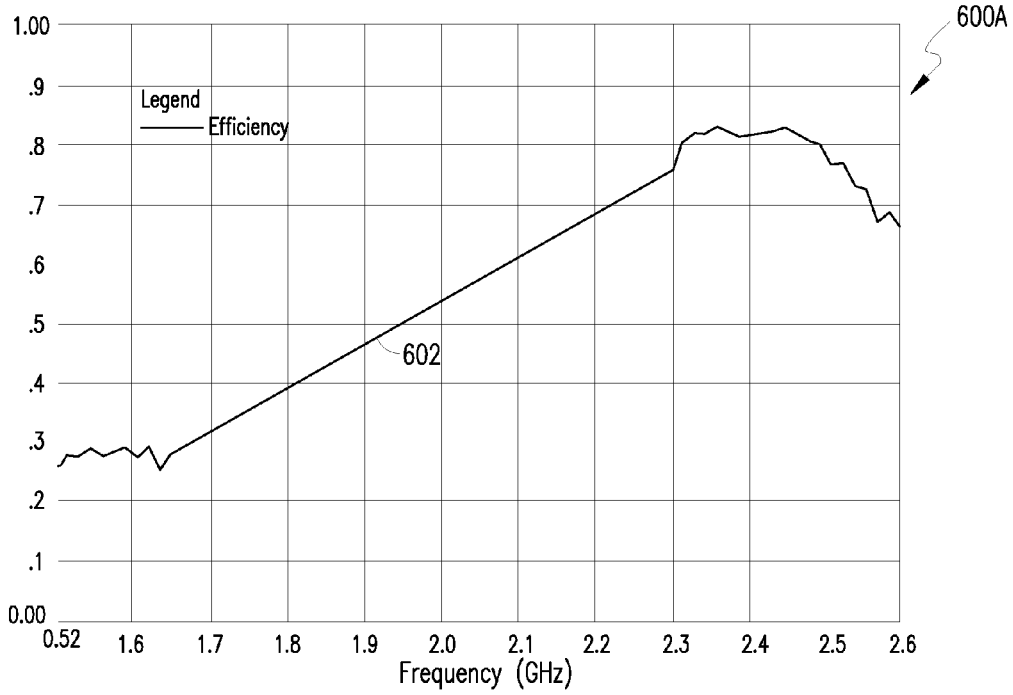
FIGS. 6A and 6B depict example graphs of measured efficiencies associated with the two ports of an embodiment of the DFDB antenna module of the present patent application.
Figure 6B:
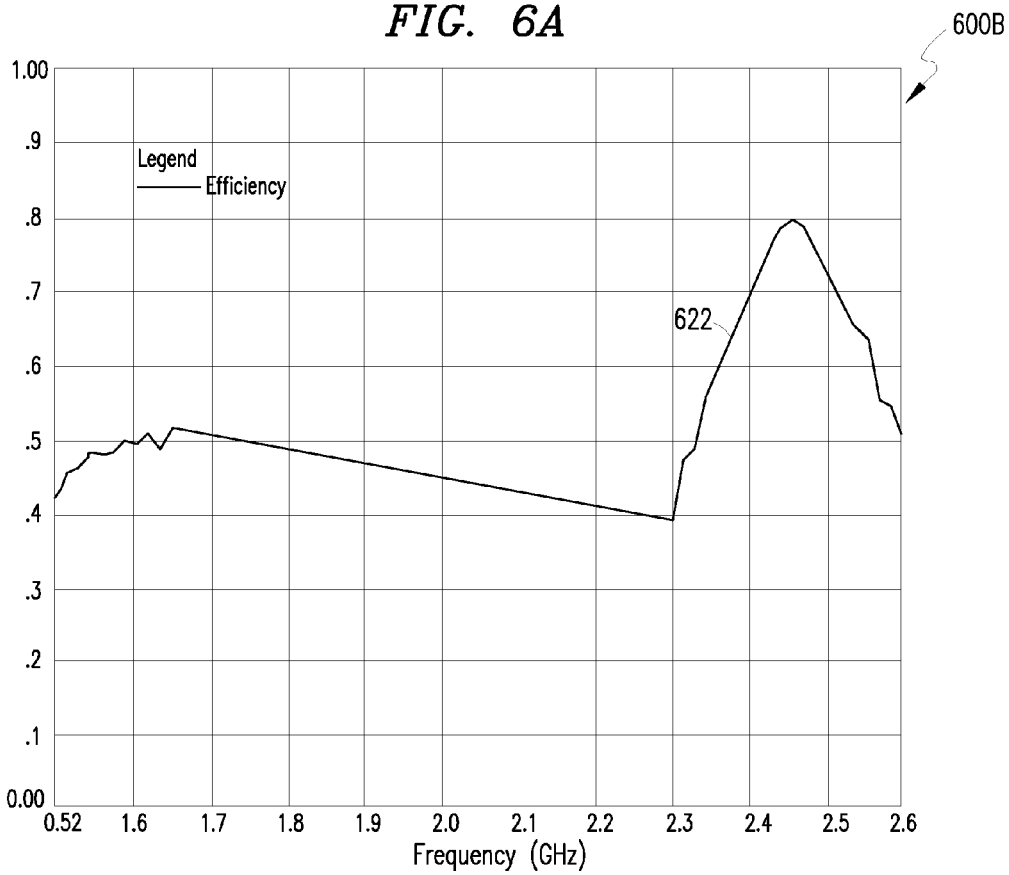

FIGS. 6A and 6B depict example graphs 600A, 600B of measured efficiencies associated with the two ports of an embodiment of the DFDB antenna module of the present patent application. Reference numeral 602 of FIG. 6A refers to the measured efficiency of feed port 1 over a frequency range, i.e., the ratio of RF power actually radiated to the RF power put into feed port 1 of the antenna module. Likewise, reference numeral 622 of FIG. 6B refers to the measured efficiency of feed port 2 over a frequency range. It can be seen that both feed ports have relatively high efficiencies at around 2.4 GHz to 2.5 GHz.

Figure 7:
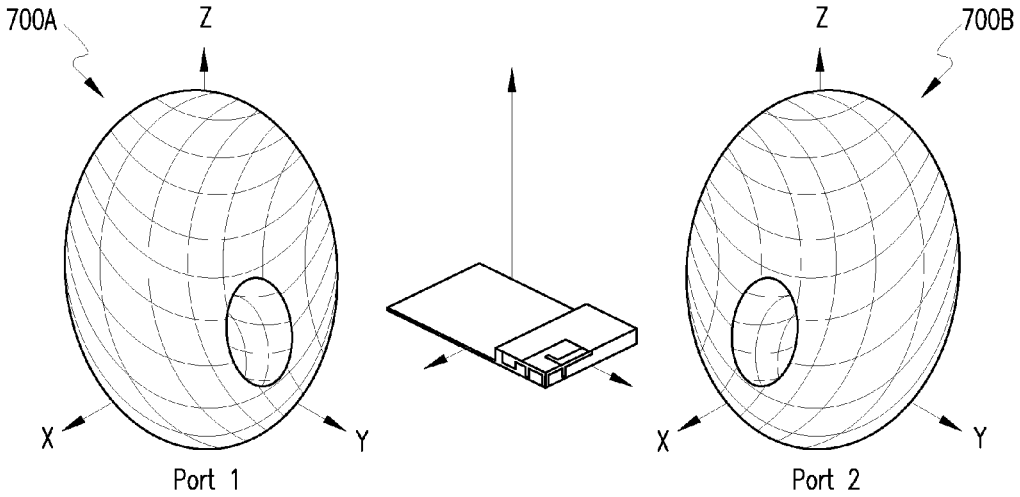
FIG. 7 depicts example measured radiation patterns associated with the two ports of an embodiment of the DFDB antenna module of the present patent application.

FIG. 7 depicts example measured radiation patterns associated with the two ports of an embodiment of the DFDB antenna module of the present patent application. As is known in the art, the radiation pattern of an antenna is a graphical depiction of the relative field strength transmitted from or received by the antenna. As antennas radiate in space often several curves are necessary to describe the antenna. If the radiation of the antenna is symmetrical about an axis (as is the case in dipole and helical antennas, for example) a unique graph is typically sufficient. Radiation pattern of an antenna can be defined as the locus of all points where the emitted power per unit surface is the same. The radiated power per unit surface is proportional to the squared electrical field of the electromagnetic wave; therefore, the radiation pattern is the locus of points with the same electrical field. In multi-port antenna assemblies, it is generally preferred that the radiation be directed mostly along the axis associated with a port. As shown in FIG. 7, reference numerals 700A and 700B refer to the measured radiation patterns associated with the two ports of the DFDB antenna module at 2.45 GHz.

Figure 8:
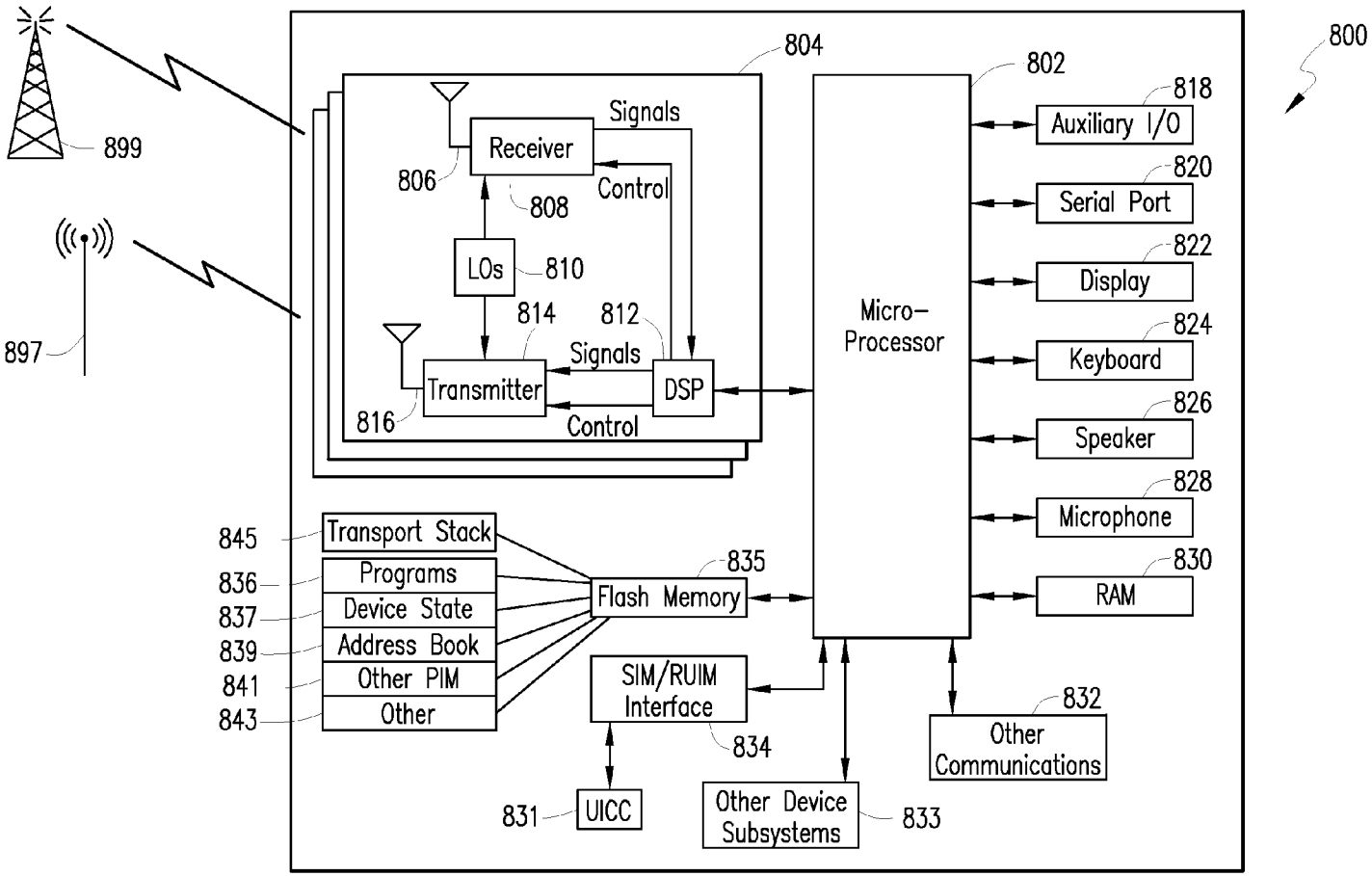
FIG. 8 depicts a block diagram of an example mobile communications device according to one embodiment of the present patent disclosure.

FIG. 8 depicts a block diagram of an example mobile communications device (MCD) 800 having a DFDB antenna module according to one embodiment of the present patent disclosure. Those skilled in the art will recognize that the mobile communications device shown in FIG. 8 can be a more elaborate exemplary implementation of the UE device 100 shown in FIG. 1. A microprocessor 802 providing for the overall control of MCD 800 is operably coupled to a multi-mode communication subsystem 804, which includes appropriate receivers 808 and transmitters 814 as well as associated components such as antenna elements 806, 816 that can be representative or illustrative of a DFDB antenna module embodiment described hereinabove. It will be recognized that appropriate GPS receiver circuitry may also be provided as part of the communication subsystem. In addition, multi-mode communication subsystem 804 may include one or more local oscillator (LO) modules 810 and processing modules such as digital signal processors (DSP) 812, for operating with multiple access technologies in different bands. As will be apparent to those skilled in the field of communications, the particular design of the communication module 804 may be dependent upon the communications network(s) with which the device is intended to operate, e.g., as exemplified by infrastructure elements 899 and 887.

Microprocessor 802 also interfaces with further device subsystems such as auxiliary input/output (I/O) 818, serial port 820, display 822, keyboard 824, speaker 826, microphone 828, random access memory (RAM) 830, other communications facilities 832, which may include for example a short-range communications subsystem, and any other device subsystems generally labeled as reference numeral 833. To support access as well as authentication and key generation, a SIM/USIM interface 834 (also generalized as a Removable User Identity Module (RUIN) interface) is also provided in communication with the microprocessor 802 and a UICC 831 having suitable SIM/USIM applications.

Operating system software and other system software may be embodied in a persistent storage module 835 (i.e., non-volatile storage) which may be implemented using Flash memory or another appropriate memory. In one implementation, persistent storage module 835 may be segregated into different areas, e.g., transport stack 845, storage area for computer programs 836, as well as data storage regions such as device state 837, address book 839, other personal information manager (PIM) data 841, and other data storage areas generally labeled as reference numeral 843. Additionally, the persistent memory may include appropriate software/firmware necessary to effectuate multi-mode communications in conjunction with one or more subsystems set forth herein under control of the microprocessor 802.

It should be recognized that at least some of the various arrangements set forth in the Figures of the present application may comprise a number of variations and modifications, in hardware, software, firmware, or in any combination, usually in association with a processing system where needed, as components configured to perform specific functions. Accordingly, the arrangements of the Figures should be taken as illustrative rather than limiting with respect to the embodiments of the present patent application.

It is believed that the operation and construction of the embodiments of the present patent application will be apparent from the Detailed Description set forth above. While the exemplary embodiments shown and described may have been characterized as being preferred, it should be readily understood that various changes and modifications could be made therein without departing from the scope of the present disclosure as set forth in the following claims.

What is claimed is:

1. A dual-feed port dual band (DFDB) antenna module, comprising:

a first antenna element disposed on a first planar surface;

a second antenna element disposed on a second planar surface; and a third antenna element disposed on a third planar surface, wherein said first, second and third planar surfaces are substantially orthogonal with respect to one another and wherein said first and second antenna elements are in electrical contact at a first common edge therebetween and said first and third antenna elements are in electrical contact at a second common edge therebetween and said second and third antenna elements are in electrical contact at a third common edge therebetween, and further wherein said second antenna element includes a feed port for coupling to one type of transceiver circuitry adapted to operate in a short-range wireless communications band and said third antenna element includes another feed port for coupling to another type of receiver circuitry adapted to operate in a GPS band.

2. The DFDB antenna module of claim 1, wherein said short-range wireless communications band comprises a 2.4 GHz band and said one type of transceiver circuitry comprises Bluetooth-compliant circuitry.

3. The DFDB antenna module of claim 1, wherein said short-range wireless communications band comprises a 2.4 GHz band and said one type of transceiver circuitry comprises Institute of Electrical and Electronics Engineers (IEEE) 802.11-compliant circuitry.

4. The DFDB antenna module of claim 1, wherein said third antenna element comprises a patch antenna.

5. The DFDB antenna module of claim 4, wherein said patch antenna includes a first rectangular portion and a second rectangular portion coupled together via a neck portion.

6. The DFDB antenna module of claim 5, wherein said first rectangular portion is approximately 15 mm by 10 mm and said second rectangular portion is approximately 10 mm by 15 mm and said neck portion is approximately 2 mm by 5 mm.

7. The DFDB antenna module of claim 1, wherein said second antenna element comprises a modified inverted F antenna strip.

8. The DFDB antenna module of claim 7, wherein said modified inverted F antenna strip is approximately 26 mm long.

9. The DFDB antenna module of claim 1, wherein said first antenna element comprises an inverted F antenna strip.

10. The DFDB antenna module of claim 9, wherein said inverted F antenna strip is approximately 26 mm long.

11. The DFDB antenna module of claim 1, wherein said feed port of said second antenna element is substantially orthogonal to said another feed port of said third antenna element.

12. The DFDB antenna module of claim 1, wherein said feed port of said second antenna element and said another feed port of said third antenna element are separated by a distance of approximately 15 mm.

13. The DFDB antenna module of claim 1, wherein said one type of transceiver circuitry is disposed in a wireless user equipment (UE) device.

* * * * *

UNITED STATES PATENT AND TRADEMARK OFFICE

CERTIFICATE OF CORRECTION

PATENT NO. : 8,390,519 B2
APPLICATION NO. : 12/683965
DATED : March 5, 2013
INVENTOR(S) : Dong Wang et al.

It is certified that error appears in the above-identified patent and that said Letters Patent is hereby corrected as shown below:

Title Page, item (54) and in the specifications, column 1, Title, "DUAL-FEED DUAL BAND ANTENNA ASSEMBLY AND ASSOCIATED METHOD" should read -- DUAL-FEED PORT DUAL BAND ANTENNA ASSEMBLY AND ASSOCIATED METHOD --.

In the Specifications:
Column 7, Line 61, "User Identity Module (RUIN)" should read -- User Identity Module (RUIM) --.

Signed and Sealed this
Twenty-first Day of May, 2013

Teresa Stanek Rea
*Acting Director of the United States Patent and Trademark Office*